US006304280B1

(12) United States Patent
Yamade et al.

(10) Patent No.: US 6,304,280 B1
(45) Date of Patent: Oct. 16, 2001

(54) THERMAL PRINTHEAD AND METHOD OF MAKING THE SAME

(75) Inventors: Takumi Yamade; Hiroaki Hayashi; Eiji Yokoyama, all of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/530,434

(22) PCT Filed: Nov. 24, 1998

(86) PCT No.: PCT/JP98/05282

§ 371 Date: May 1, 2000

§ 102(e) Date: May 1, 2000

(87) PCT Pub. No.: WO99/26787

PCT Pub. Date: Jun. 3, 1999

(30) Foreign Application Priority Data

Nov. 26, 1997 (JP) ..... 9-324230

(51) Int. Cl.[7] ..... B41J 2/335
(52) U.S. Cl. ..... 347/203; 347/200; 347/202
(58) Field of Search ..... 400/120.01, 120.09; 347/201, 202, 204, 203, 207, 205, 206

(56) References Cited

U.S. PATENT DOCUMENTS 4,626,872 * 12/1986 Takeno ..... 346/76 PH
5,099,257 * 3/1992 Nakazawa et al. ..... 346/76 PH
5,367,321 11/1994 Shigenori et al. ..... 346/76

FOREIGN PATENT DOCUMENTS 0 395 001 10/1990 (EP) ..... B41J/2/335
0 654 354 5/1995 (EP) ..... B41J/2/335
2-8946 1/1990 (JP) ..... B41J/3/20
05092596 * 4/1993 (JP) .
5-92596 4/1993 (JP) ..... B41J/2/335

* cited by examiner

*Primary Examiner*—John S. Hilten
*Assistant Examiner*—Kevin D. Williams
(74) *Attorney, Agent, or Firm*—Michael D. Bednarek; Shaw Pittman LLP

(57) ABSTRACT

A thermal printhead 1 according to the present invention includes a multiplicity of heating elements 4*a* formed in a row on an obverse surface of an elongated substrate 2 at a portion which is offset widthwise toward one longitudinal side of the substrate, and a protective film 8 formed on the obverse surface of the substrate 2 at the widthwise offset portion for covering the heating elements 4*a*. The protective film 8 is formed to extend on the obverse surface of the substrate 2 continuously from the widthwise offset portion onto one longitudinal side surface 2*a* of the substrate. A longitudinal edge 8*b* of the protective film 8 directed toward the other longitudinal side of the substrate 2 is tapered.

6 Claims, 10 Drawing Sheets

THERMAL PRINTHEAD AND METHOD OF MAKING THE SAME

TECHNICAL FIELD

The present invention relates to a thermal printhead which is designed to perform printing on a recording medium thermosensitively or by thermal transfer. It also relates to a method of making such a thermal printhead.

BACKGROUND ART

FIG. 7 is a schematic plan view of a prior art thin-film thermal printhead. The thermal printhead 51 includes an elongated rectangular substrate 52 having longitudinal sides 52*a* and 52*b*. The substrate 52 has a surface formed with a linear resistor layer 53 extending longitudinally adjacent one longitudinal side 52*a*. A band-like region between the resistor layer 53 and the longitudinal side 52*a* of the substrate 52 is provided with a common wiring pattern 54. The common wiring pattern 54 has opposite ends extending to the other longitudinal side 52*b* of the substrate 52. One of the opposite ends of the common wiring pattern 54 is connected to a common terminal 55.

FIG. 8 is an enlarged plan view showing a principal portion of the thermal printhead 51. The common wiring pattern 54 includes a plurality of comb-tooth electrodes 54*a* extending therefrom. Individual electrodes 56 have respective one end extending between two adjacent comb-tooth electrodes 54*a*. The other end of each individual electrode 56 extends adjacent to a drive IC 57 mounted on the substrate 52 and is connected, via a non-illustrated wire-bonding pad, to an output terminal of the drive IC 57.

As indicated by the chain lines in FIG. 8, the resistor layer 53 is laid over the comb-tooth electrodes 54*a* and the individual electrodes 56 alternate therewith, thereby defining a heating element 53*a* between each two adjacent comb-tooth electrodes 54*a*. Thus, when power is applied to any individual electrode 56, current passes through a portion of the resistor layer 53 defined between two comb-tooth electrodes 54*a* sandwiching this individual electrode 56, consequently working as a heating element 53*a*.

FIG. 9 is an enlarged sectional view showing a principal portion of the thermal printhead 51. The substrate 52 formed of an insulating material such as alumina ceramic material is provided, on a surface thereof, with a glaze layer 61 extending longitudinally at a portion adjacent to the longitudinal side 52*a*. The glaze layer 61 is formed with a resistor layer 53 in the form of a thin film for covering the glaze layer. Conductor layers 62*a*, 62*b* are formed on the resistor layer 53 in such a manner as to expose the resistor layer 53 at a portion at the top of the glaze layer 61. The exposed portion of the resistor layer 53 serves as heating elements 53*a*. The conductor layer 62*b* extending rightward in FIG. 9 serves as the individual electrodes 56, whereas the conductor layer 62*a* extending leftward in FIG. 9 serves as comb-tooth electrodes 54*a*. Further, an anti-oxidation film 63 and a protective film 64 are formed to cover the heating elements 53*a* and the conductor layers 62*a*, 62*b* while exposing the wire-bonding pad of each individual electrode 56.

An aggregate board divisible into a plurality of substrates 52 may be used for forming the glaze layer 61, the resistor layer 53, the conductor layers 62*a*, 62*b* and the anti-oxidation film 63A. A protective film 64 is further formed on the aggregate board thus formed with the anti-oxidation film 63. Specifically, the protective film 64 may be formed in the following manner for example. First, a resist layer 65 is formed to cover the region, including the wire-bonding pads, which is not to be covered with the protective film 64. Then, a $Ta_2O_5$ film for example may be formed by chemical vapor deposition or spattering. Subsequently, the resist layer 65 is etched away. The aggregate board thus formed with the protective film 64 is then divided into a plurality of individual substrates 52 to each of which drive ICs 57 are mounted. The drive ICs 57 and the individual electrodes 56 are connected by wire-bonding for example to provide a thermal printhead 51.

However, according to the method described above, the thermal printhead 51 is prepared by dividing the aggregate board after forming the protective film 64. Accordingly, the divisional surface 66, namely the side surface of the substrate 52 along the longitudinal side 52*a* at longitudinal edge of each layer 61, 53, 62*a*, 63, are not formed with the protective film 64. Thus, the divisional surface 66 is exposed. Generally, the division of the aggregate board is performed, for example, by providing a nick along a scribing line and then applying stress therealong. This results in irregularities at the divisional surface 66, which is, therefore, in poor condition. In this way, the divisional surface 66 of the thermal printhead 51 is not only in a poor condition but also is exposed. Accordingly, during handling of the thermal printhead 51 such as incorporation into a casing, the edge of the substrate 52 along the longitudinal side 52*a* or the edges of the layers 61, 53, 62*a*, 63 may chip or break if the side surface of the substrate 52 along the longitudinal side 52*a* comes into contact with the casing or any other object.

Further, since the protective film 64 is formed by first forming the resist layer 65 and then removing the resist layer 65 after the growth of the protective film, an edge 64*a* of the protective film 64 results in a step which is equivalent in height to the thickness to the protective layer 64. When the thermal printhead 51 having such a step at the edge 64*a* of the protective film 64 is incorporated in an image forming apparatus, an edge of a recording paper 67 transferred in contact with the heating elements 53*a* may get caught at the step. In such a case, the image forming apparatus recognizes a paper jam because the recording paper 67 does not reach the heating elements 53*a*, thus resulting in stoppage of the apparatus.

Another method of making a thermal printhead is also proposed wherein a plurality of substrates 71 are laminated in such a manner as to expose a film-forming portion of each substrate 71 which is subsequently formed with a protective film by spattering (See e.g. JP-A-5-92596), as shown in FIG. 10. At the time of forming a glaze layer on the substrate 71, a plurality of projections 72 each made of the same material as the glaze layer are formed in a row on the surface of the substrate. These projections 72 are provided to prevent the laminated substrates 71 from rubbing against each other to avoid damaging of the individual electrodes or other elements due to such rubbing.

However, such a method makes it necessary to provide a mounting space on the surface of the substrate 71 for mounting the plurality of projections, which may bar increasing the density of the wiring pattern. Moreover, depending on the location of the projections 72, the edge of the recording paper may get caught at the projections 72 during the recording operation of the thermal printhead.

DISCLOSURE OF THE INVENTION

It is an object of the present invention to prevent a thermal printhead from partially breaking due to the bad surface condition and to minimize the likelihood that a recording paper gets caught in during the recording.

In accordance with a first aspect of the present invention, there is provided a thermal printhead comprising: a multiplicity of heating elements formed in a row on an obverse surface of an elongated substrate at a portion which is offset widthwise toward one longitudinal side of the substrate, and a protective film formed on the obverse surface of the substrate at the widthwise offset portion for covering the heating elements, wherein the protective film is formed to extend on the obverse surface of the substrate continuously from the widthwise offset portion onto one longitudinal side surface of the substrate, and wherein a longitudinal edge of the protective film directed toward the other longitudinal side of the substrate is tapered.

In a preferred embodiment, the protective film extends to a boundary between said one longitudinal side surface and a reverse surface of the substrate.

In accordance with a second aspect of the present invention, there is provided a method of forming a thermal printhead which comprises a multiplicity of heating elements formed in a row on an obverse surface of an elongated substrate at a portion which is offset widthwise toward one longitudinal side of the substrate, and a protective film formed on the obverse surface of the substrate at the widthwise offset portion for covering the heating elements; the method comprising the steps of: forming heating elements on an aggregate board which is divisible into a plurality of substrates; dividing the aggregate board into a plurality of substrates each formed with the heating elements; and forming a protective film on each of the substrates; wherein the protective film is formed to extend on the obverse surface of the substrate continuously from the widthwise offset portion onto one longitudinal side surface of the substrate; and wherein a longitudinal edge of the protective film directed toward the other longitudinal side of the substrate is tapered.

In a preferred embodiment, the protective film is formed to extend to a boundary between said one longitudinal side surface and a reverse surface of the substrate.

In another preferred embodiment, the protective film is formed in a state in which the plurality of substrates are laminated in a thickness direction but shifted widthwise from each other so that portions to be formed with the protective film are exposed.

Various features and advantages of the present invention will become clearer from the embodiment described below with reference to the accompanying drawings.

BEST MODE FOR CARRYING OUT THE INVENTION

A preferred embodiment of the present invention will be described with reference to FIGS. 1 through 6. In this embodiment, a thin-film thermal printhead is employed.

Figure 1:
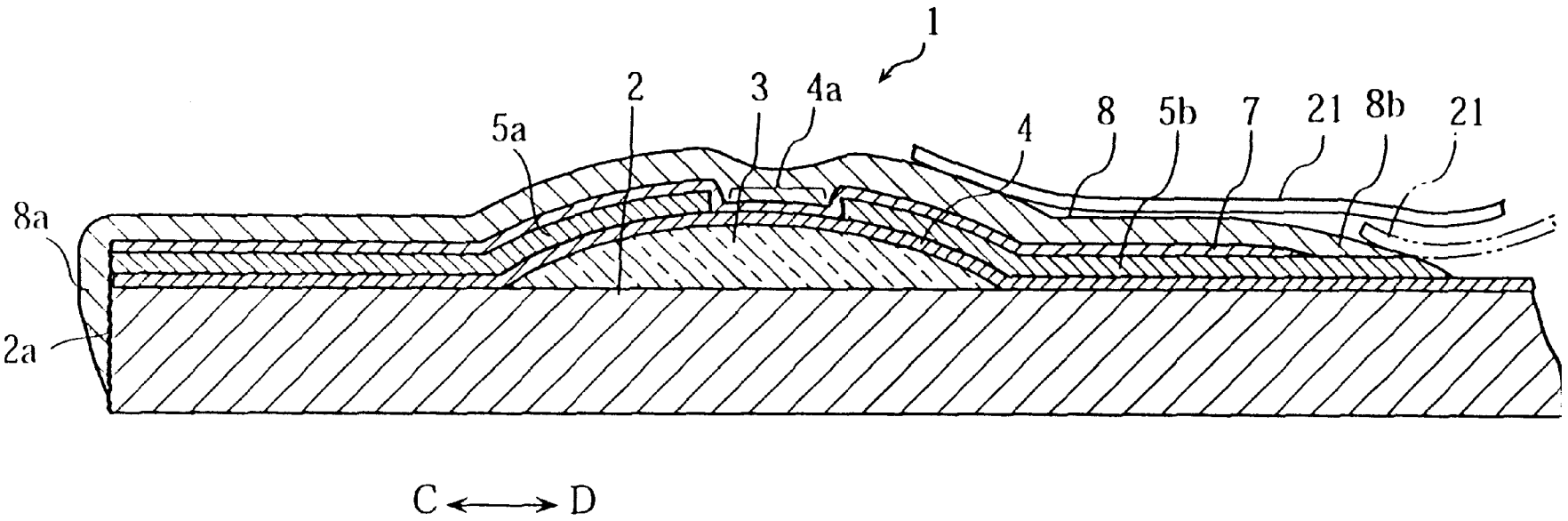
FIG. 1 is a sectional view showing a principal portion of a thermal printhead embodying the present invention.
Figure 2:
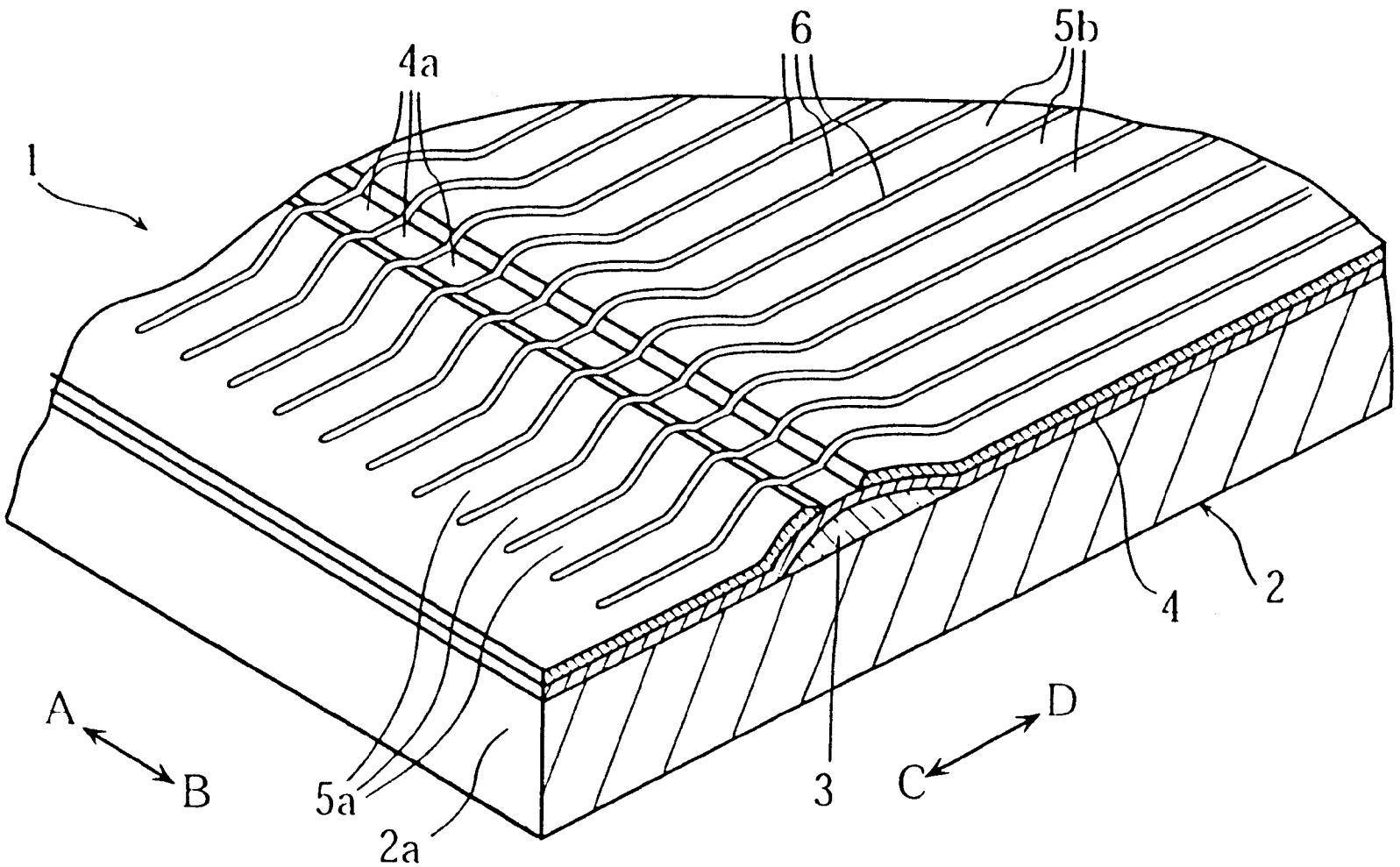
FIG. 2 is a perspective view of the thermal printhead shown in FIG. 1 in a state in which an anti-oxidation film and a protective film are not formed.

As shown in FIGS. 1 and 2, a thermal printhead 1 includes an elongated substrate 2 formed of an insulating material such as alumina ceramic material. The substrate 2 is formed, at a widthwise offset portion on an obverse surface thereof, with a glaze layer 3 extending longitudinally (i.e. in the direction of the arrow AB in FIG. 2). The glaze layer 3 is formed by printing and baking a glass paste material for example. The glaze layer has a smoothly arched cross section due to the flow of the glass component during the baking.

On the substrate 2 and the glaze layer 3, a resistor layer 4 in the form of a thin film is formed to cover the glaze layer 3. For instance, the resistor layer 4 may be formed by CVD (chemical vapor deposition) or spattering $TaSiO_2$ to have a thickness of 500 to 1500 Å.

Conductor layers 5*a,* 5*b* are formed on the resistor layer 4. The conductor layers 5*a,* 5*b* are etched or otherwise processed to expose a predetermined portion of the resistor layer 4 over the top of the glaze layer 3. The exposed portion of the resistor layer 4 serves as heating elements 4*a*.

As clearly shown in FIG. 2, a plurality of slits 6 extending widthwise of the substrate 2 (i.e. in the direction of the arrow CD in FIGS. 1 and 2) are formed in the resistor layer 4 and the conductor layers 5*a,* 5*b*. The slits 6 may be formed, for example, by etching the resistor layer 4 and the conductor layers 5*a,* 5*b*. The provision of the slits 6 allows each of the heating elements 4*a* to be driven individually. The conductor layer 5*b* extending rightward from the heating elements 4*a* in FIGS. 1 and 2 serves as individual electrodes. The conductor layer 6*a* extending leftward from the heating elements 4*a* in FIGS. 1 and 2 serves as a common electrode.

The heating elements 4*a* are covered with an anti-oxidation film 7 which is formed in a manner such as to expose wire-bonding pads of the individual electrodes. The anti-oxidation film 7 may be formed, for example, by depositing $SiO_2$ into a thickness of 3000 to 6000 Å through CVD or spattering.

A protective film 8 is formed on the anti-oxidation film 7. The protective film 8 extends continuously so that one longitudinal edge 8*a* thereof lies on a longitudinal side surface 2*a* of the substrate 2. The protective film 8 on the side surface 2*a* reaches the boundary between the side surface 2*a* and the reverse surface of the substrate 2. The other longitudinal edge 8*b* of the protective film 8 is tapered. Thus, the longitudinal edge 8*b* of the protective film 8 gradually reduces in thickness toward the end portion. The protective film 8 may be formed by depositing $Ta_2O_5$ or $Si_3N_4$ into a thickness of from 2 to 4 $\mu$m through CVD or spattering.

The method of forming the protective film 8 will be briefly described below with reference to FIGS. 3 through 6.

Figure 3:
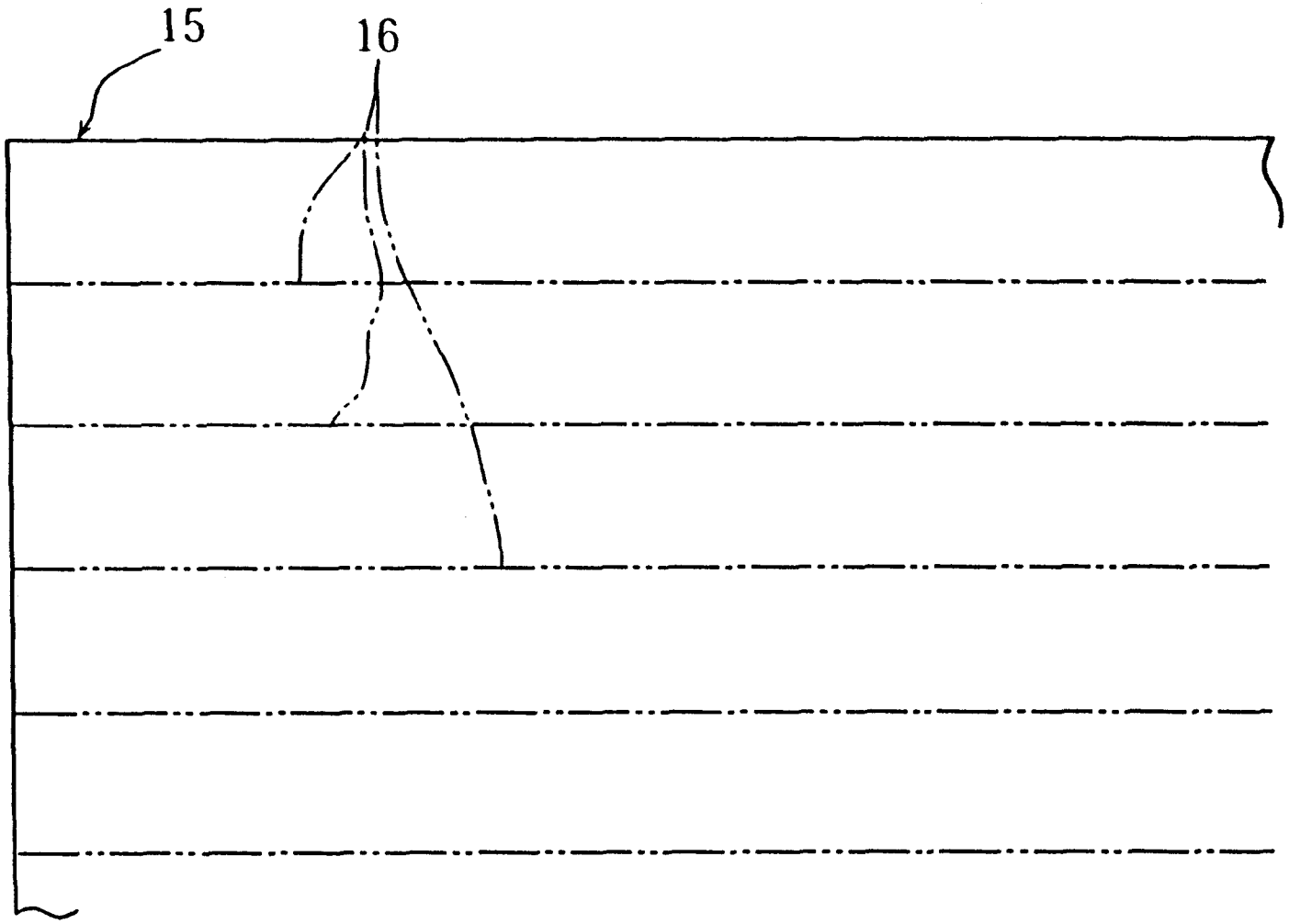
FIG. 3 illustrates an aggregate board used for providing the thermal printhead shown in FIG. 1.

As shown in FIG. 3, a glaze layer 3, a resistor layer 4, conductor layers 5*a,* 5*b* and an anti-oxidation film 7 are formed on an aggregate board 15 which is divisible into a plurality of substrates 2 each formed subsequently into a thermal printhead 1. However, a protective film 8 is formed on each of the individual substrates 2, instead of the aggregate board 15, after dividing the aggregate board 15 along scribing lines 16. According to this embodiment, a protective film 8 is formed on the plurality of substrates 2 simultaneously instead of forming a protective film 8 on each of the substrates 2 in a separate step.

Figure 4:
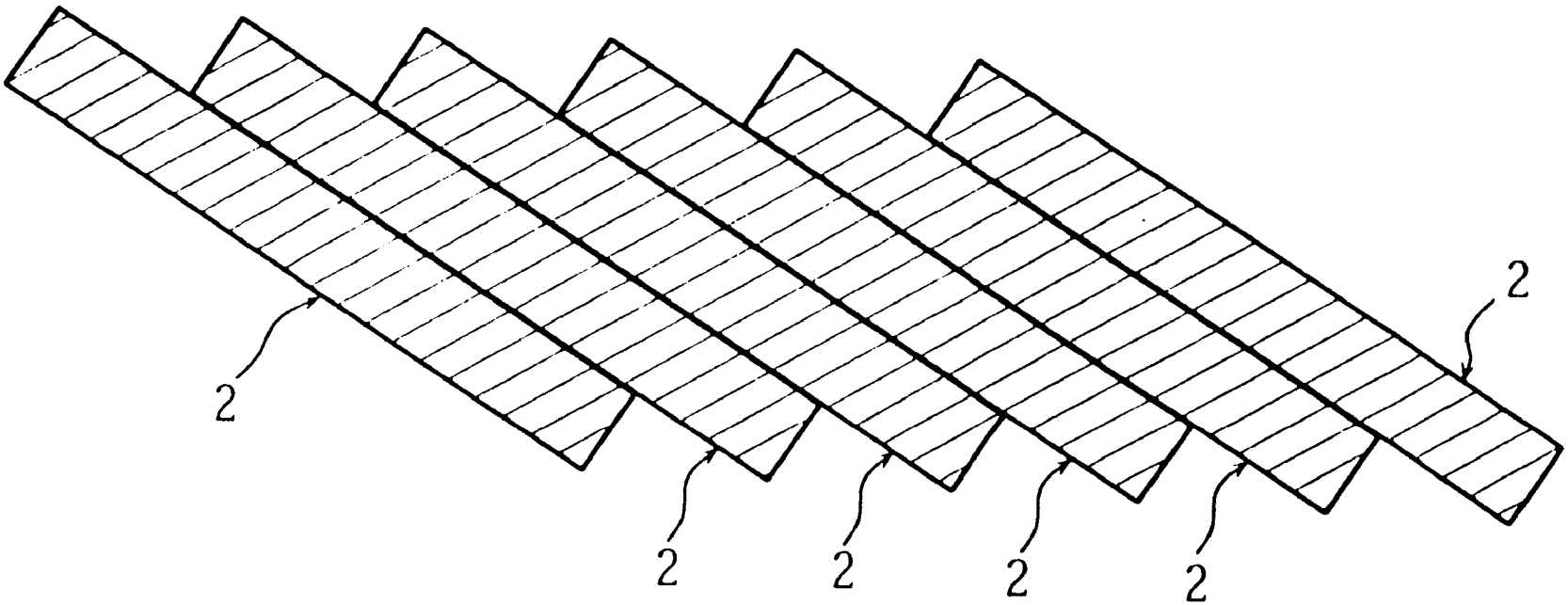
FIG. 4 is a sectional view showing substrates which are laminated for forming a protective film in making the thermal printhead shown in FIG. 1.

Specifically, as shown in FIG. 4, six substrates 2 obtained from an aggregate board 15 for example are laminated in their thickness direction in widthwise offset relationship. Thus, the portions of the substrates later formed with a protective film 8 are exposed as viewed in plan. In this condition wherein most of the anti-oxidation film 7 of each substrate covering the heating elements 4*a* as well as the side surface 2*a* of each substrate 2 next to the anti-oxidation film are exposed, a protective film 8 is formed simultaneously on the respective substrates 2. In FIG. 4, the substrates 2 are depicted as if they are in close contact with each other. In fact, however, since the glaze layer 3 and the other layers are formed on each substrate 2, a small gap is formed between the adjacent substrates 2 when they are laminated together.

Figure 5:
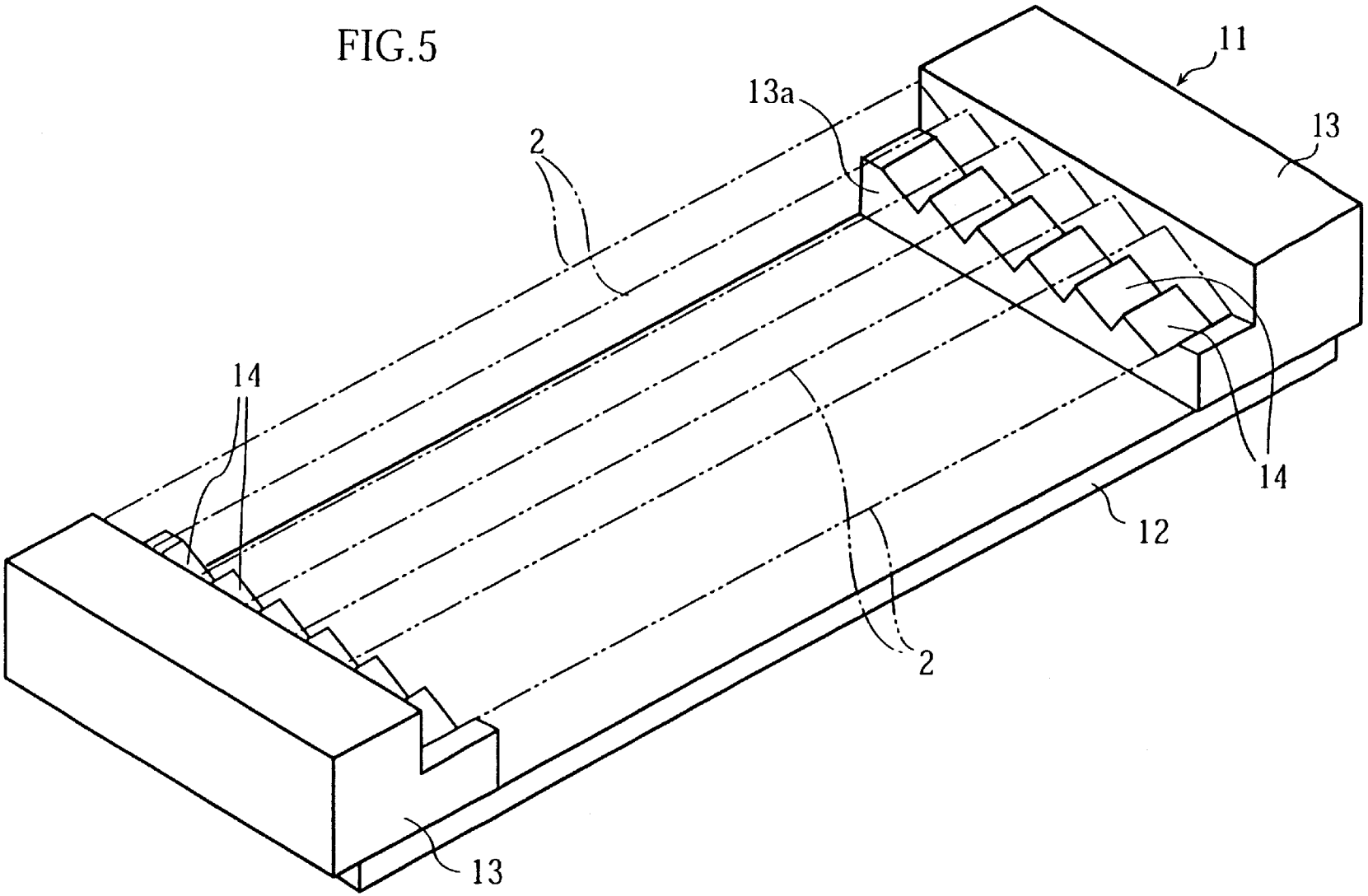
FIG. 5 is a perspective view showing an example of jig for keeping the laminated state of the substrates in forming the thermal printhead shown in FIG. 1.
Figure 6:
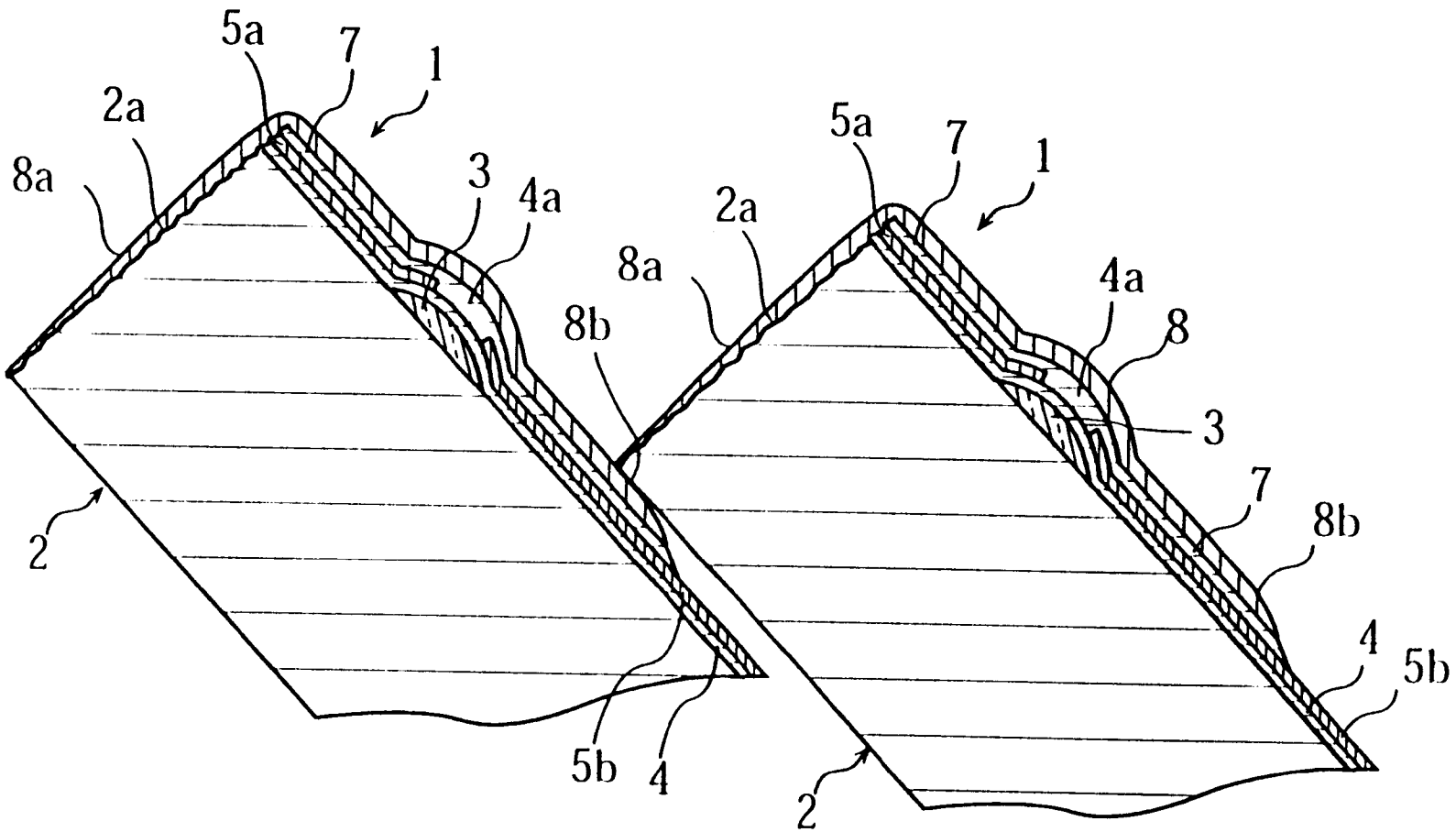
FIG. 6 is an enlarged sectional view showing a principal portion of the protective film in making the thermal printhead shown in FIG. 1.
Figure 7:
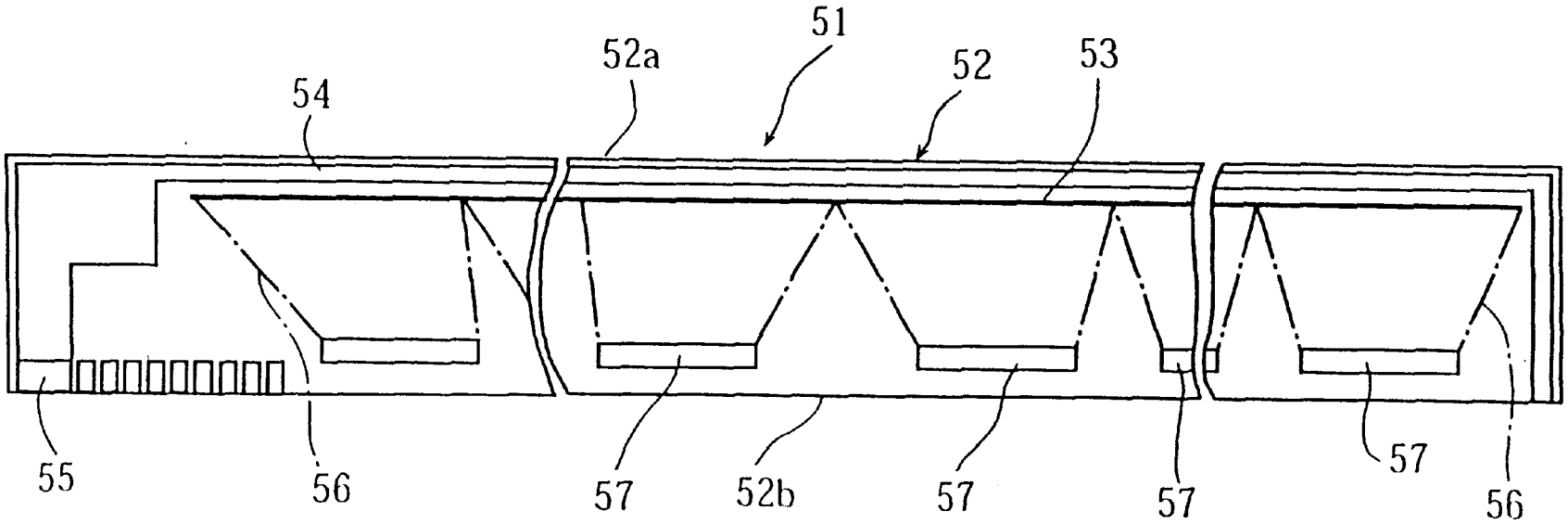
FIG.7 PRIOR ART
FIG. 7 is a schematic plan view showing a prior-art thermal printhead.
Figure 8:
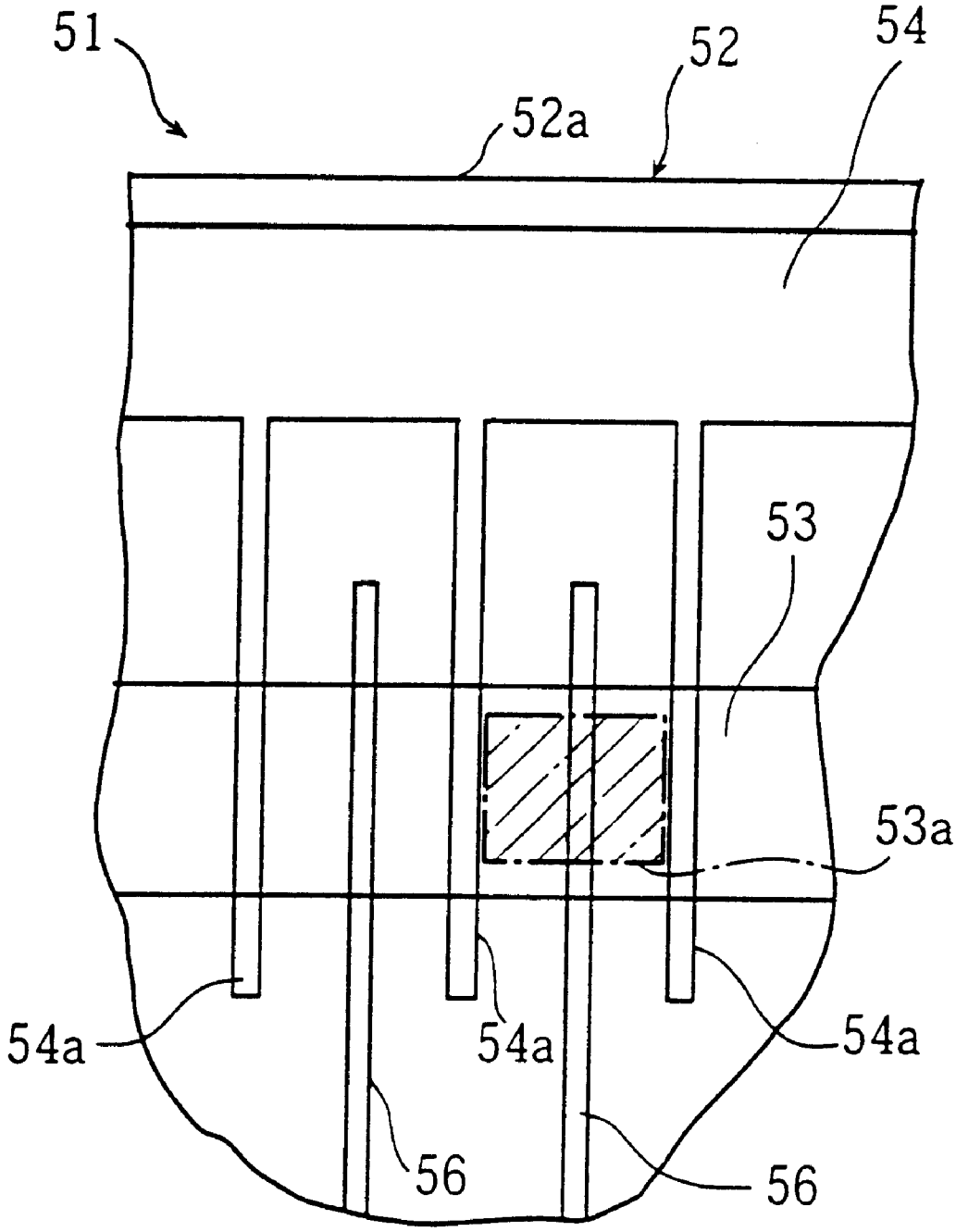
FIG.8 PRIOR ART
FIG. 8 is an enlarged plan view showing a principal portion of the thermal printhead shown in FIG. 7.

To keep such a state of the substrates in which the portions later formed with a protective film 8 are exposed, a jig 11 shown in FIG. 5 may be used for example. The jig 11 may comprise a base member 12 and a pair of mounts 13 provided at longitudinally opposite ends of the base member 12. Each of the mounts 13 is formed with a plurality of retreated steps 14 (six steps in this embodiment) each extending to a side surface 13*a*. The retreated steps 14 are formed as part of a continuous serration. The pair of mounts 13 are disposed so that the respective serrated portions directed toward each other. The substrates 2 are placed so as to bridge between the retreated steps 14 of the paired mounts 13.

With the posture of the substrates 2 kept by the jig 11, a protective film 8 is formed on the exposed portion of each substrate. The protective film may be formed by depositing $Ta_2O_5$ or $Si_3N_4$ into a thickness of from 2 to 4 $\mu$m through CVD or spattering for example. Thus, the protective film 8 is formed not only on the anti-oxidation film 7 but also continuously onto the side surface 2*a* of the substrate 2. The spattering may be continued at least until the protective film 8 reaches the boundary between the side surface 2*a* and the reverse surface of the substrate 2.

Due to such a structure, even if the side surface 2*a* of the substrate 2 and the edges of the layers 4, 5*a*, 7 are irregular, the protective film 8 covers these surface and edges. Therefore, even if the side surface 2*a* of the substrate 2 or the edges come into contact with a casing or any other object during handling of the thermal printhead 1 such as incorporation thereof into the casing, it is possible to prevent the side surface 2*a* of the substrate 2 and the edges of the layers 4, 5*a*, 7 from being chipped or broken.

Further, according to the above-described method of forming a protective layer 8, the portion to be formed with the protective layer 8 is exposed, whereas the portion not to be formed with such a layer is shielded by another substrate 2 laid thereon. Accordingly, it is unnecessary to form a resist layer on each substrate at a portion not to be formed with a protective layer 8, thereby eliminating the need for etching the resist layer.

Unlike a resist layer, each substrate 2 laid over an adjacent substrate at a portion not to be formed with a protective film 8 is not bonded to that adjacent substrate 2. Accordingly, during the growth of the protective film 8, the edge of each substrate 2 laid over the adjacent substrate is somewhat spaced, allowing the protective film to grow at the overlapping portion. However, the film growth is slower at the overlapping portion of the substrate 2 than at the exposed portion of the substrate. As a result, the other longitudinal edge 8*b* of the protective film 8 is tapered to have a progressively reducing thickness toward its extremity.

Figure 9:
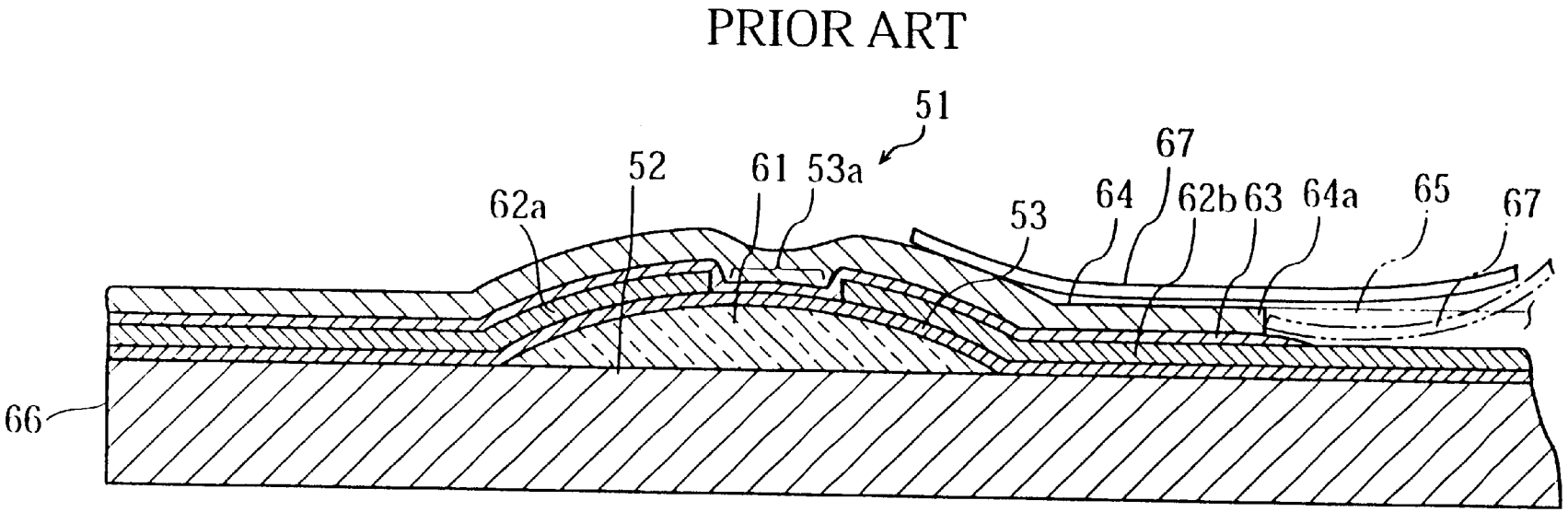
FIG.9 PRIOR ART
FIG. 9 is an enlarged sectional view showing a principal portion of the thermal printhead shown in FIG. 7.
Figure 10:
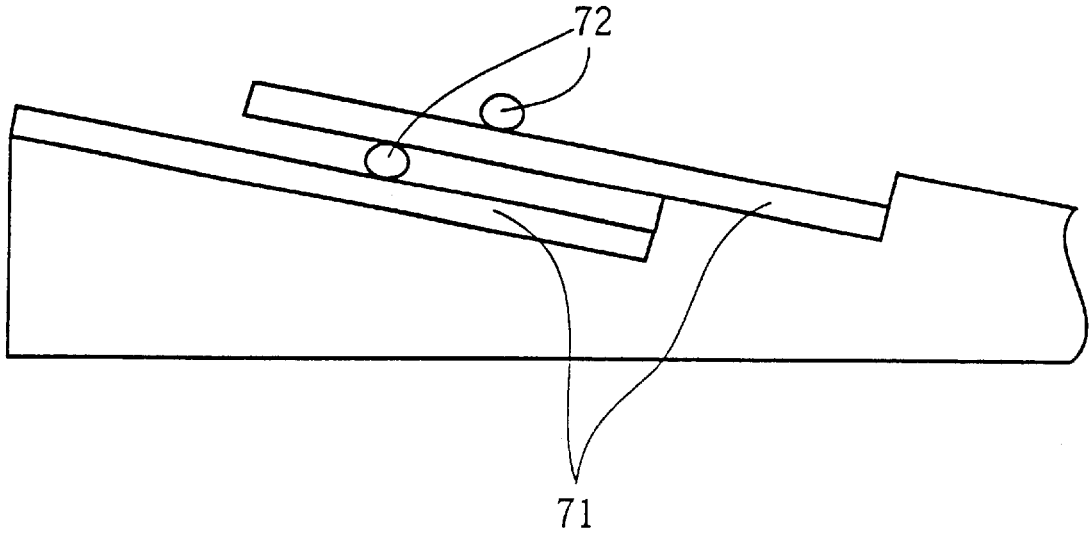
FIG.10 PRIOR ART
FIG. 10 illustrates a method of forming another prior art thermal printhead.

In the conventional thermal printhead shown in FIG. 9, the edge 64*a* of the protective film 64 provides a stepped portion. According to this embodiment, by contrast, the longitudinal edge 8*b* of the protective film 8 is tapered as shown in FIG. 1. Accordingly, with an image forming apparatus provided by incorporating the thermal printhead 1 in a casing or the like, the tip portion of a recording paper 21 as a recording medium is not caught at the longitudinal edge 8*b* of the protective film 8 during transfer of the recording paper 21. More specifically, in the image forming apparatus incorporating the thermal printhead 1, the protective film 8 is tapered at the longitudinal edge 8*b* to allow smooth paper transfer, as clearly shown in FIG. 1. Accordingly, a paper jam due to the provision of the protective film 8 is avoided.

In the embodiment described above, the protective film 8 is formed simultaneously on six substrates 2. However, the number of substrates 2 to which the protective film 8 is simultaneously formed may be appropriately varied. Further, the design of the jig 11 for keeping the position of the substrates 2 may be modified in various ways.

Although the present invention is applied to a so-called thin-film thermal printhead in the above embodiment, it is clear that the present invention may be also applied to a thick-film thermal printhead.

What is claimed is:

1. A thermal printhead comprising:

an elongated substrate including an obverse surface, a first longitudinal edge face and a second longitudinal edge face opposite to the first longitudinal edge face;

a glaze layer formed on the obverse surface of the substrate adjacent to but spaced from the first longitudinal edge face of the substrate;

a multiplicity of heating elements formed in a row on the glaze layer;

a protective film formed on the obverse surface of the substrate for covering the heating elements;

wherein the protective film is formed on the obverse surface of the substrate for covering the heating elements, the protective film extending onto the first longitudinal edge face of the substrate in direct contact therewith the protective film terminating with a taper on the first longitudinal edge face; and wherein a longitudinal edge of the protective film directed toward the second longitudinal edge face of the substrate is tapered.

2. The thermal printhead according to claim 1, wherein the protective film extends to a boundary between the first longitudinal edge face and a reverse surface of the substrate.

3. A method of forming a thermal printhead which comprises an elongated substrate including an obverse surface, a first longitudinal edge face and a second longitudinal edge face; a glaze layer formed on the obverse surface of the substrate adjacent to but spaced from the first longitudinal edge face of the substrate; the method comprising the steps of:

forming a multiplicity of heating elements in a row on each of the glaze layers on an aggregate board which is divisible into a plurality of substrates;

dividing the aggregate board into a plurality of substrates each formed with the heating elements; and forming a protective film on the obverse surface of each said substrate;

wherein the protective film is formed to extend onto the first longitudinal edge face of each said substrate in direct contact therewith the protective film terminating with a taper on the first longitudinal edge face; and wherein a longitudinal edge of the protective film directed toward the second longitudinal edge face of each said substrate is tapered.

4. The method of forming a thermal printhead according to claim 3, wherein the protective film is formed to extend to a boundary between the first longitudinal edge face and a reverse surface of each said substrate.

5. The method of forming a thermal printhead according to claim 3, wherein the protective film is formed in a state in which the plurality of substrates are laminated in a thickness direction but shifted from each other in a direction from the first longitudinal edge face to the second longitudinal edge face so that portions to be formed with the protective film are exposed.

6. The thermal printhead according to claim 1, further comprising a common electrode extending from the glaze layer toward the first longitudinal edge face of the substrate, the common electrode not covering the first longitudinal edge face.

* * * * *